United States Patent [19]

Silberstein et al.

[11] 4,424,819

[45] Jan. 10, 1984

[54] CIGARETTE FILTER

[75] Inventors: Donald A. Silberstein, LeMans, France; Andrew McMurtrie, Louisville, Ky.

[73] Assignee: Brown & Williamson Tobacco Corporation, Louisville, Ky.

[21] Appl. No.: 364,113

[22] Filed: Mar. 31, 1982

[51] Int. Cl.[3] ..... A24D 3/04

[52] U.S. Cl. ..... 131/336; 131/339; 131/361; 131/362; 131/363

[58] Field of Search ..... 131/336, 339, 340, 361, 131/362, 363

[56] References Cited

U.S. PATENT DOCUMENTS

| | | | |
|---|---|---|---|
| 3,910,288 | 10/1975 | Hammersmith et al. | 131/336 |
| 4,022,221 | 5/1977 | Berger | 131/340 |
| 4,256,122 | 3/1981 | Johnson | 131/336 |
| 4,343,319 | 8/1982 | Cantrell | 131/336 |

*Primary Examiner*—Vincent Millin
*Attorney, Agent, or Firm*—Charles G. Lamb

[57] ABSTRACT

A filter for a cigarette includes a porous filter rod circumscribed by a non-porous or air impermeable wrapper, and ventilating air grooves embedded in the wrapped filter rod which extend from one end of the filter rod a preselected distance generally longitudinally thereof. The ends of the grooves are recessed a predetermined distance or depth inwardly of the end of the filter rod and communicate with radially extending open channels formed in the one end of the filter rod. An air permeable tipping material circumscribes the wrapped filter rod which provides a path for ventilating air flow into the grooves. Due to the air impermeable wrapper, the air flowing in the grooves is segregated from the smoke flowing through the filter rod so that ventilating air is the only substance flowing in the grooves.

11 Claims, 9 Drawing Figures

CIGARETTE FILTER

BACKGROUND OF THE INVENTION

1. Field of the Invention

This invention relates to a filter for cigarettes. In one aspect it relates to a filter with novel ventilating means. In another respect the invention relates to a filter for a cigarette having flow directing grooves formed therein for directing ventilating air to the mouth end of the filter and creating turbulent air flow at the mouth end of the filter.

2. Description of the Prior Art

It is well known in the art to add filters to cigarettes wherein the filters are provided with ventilation means to bring ambient air into the filter to dilute the smoke stream passing therethrough. The dilution of the smoke stream reduces the quantity of smoke particulates as well as the gas phase components which are delivered to the smoker's mouth. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream. Also the cigarette wrapper may be perforated at selected locations along the length of the cigarette which provides ports in the cigarette through which ventilating air enters. Even further, it is known to perforate the wrapper of the filter on the cigarette to allow ventilating air to enter the filter and dilute the smoke stream. There have also been a number of suggestions for incorporating grooves within the filter of a filter cigarette to facilitate the addition of ventilating air into the smoke stream.

For example, U.S. Pat. No. 3,596,663 relates to a tobacco smoke filter provided with a corrugated porous plug wrap surrounding a filter element which is circumscribed by tipping paper having flow-through perforations. The ventilating air enters into the filter element and the grooves through the perforations in the tipping paper and progresses to the smoker's mouth. And, U.S. Pat. No. 4,256,122 teaches a filter for a ciarette which includes grooves extending longitudinally along the outer surface of a filter rod circumscribed by a non-porous plug wrap and the rod and wrap are enclosed with ventilating tipping paper so that, in use, only ventilating air travels down the grooves and only smoke travels through the filter. Other patents which relate to cigarette filters having grooves circumscribing the filter element for the introduction of ventilating air into the cigarette filter include U.S. Pat. No. 3,577,995; U.S. Pat. No. 3,752,347; U.S. Pat. No. 3,490,461; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; U.S. Pat. No. 4,256,122 and U.S. Pat. No. 3,910,288.

SUMMARY OF THE INVENTION

The present invention advantageously provides a straightforward arrangement of a filter for a cigarette which in one form achieves essentially normal cigarette pressure drop with low to moderate efficiency filters. The present invention further provides a cigarette filter for lowering tar predominantly by ventilation while also providing filtration of the tobacco smoke. The present invention further provides a filter ventilation system for a cigarette utilizing grooves in the filter rod extending from the mouth end of the filter a predetermined distance generally longitudinally thereof and which are recessed inwardly of the mouth end of the filter rod.

More particularly, the present invention provides a filter for a cigarette comprising a porous filter rod of generally cylindrical configuration, an air impermeable wrapper extending longitudinally along said filter rod from one end thereof to the other and circumscribing said filter rod leaving flow through opposing ends of said rod, said wrapper being formed with at least one groove embedded into said filter rod, said at least one groove being open to one end of said filter rod and extending therefrom in a generally longitudinal direction of said filter rod for a distance less than the length of said filter rod, and the open end of said at least one groove being recessed a predetermined distance inwardly of the end of said filter rod, means defining at least one open cavity in the end of said filter rod, said at least one cavity being in air flow communication with said open end of said at least one groove and extending from said open end of said at least one groove in a generally radial direction of said filter rod, and tipping material extending longitudinally of and circumscribing said wrapped filter rod, said tipping material being air permeable for permitting ventilating air flow therethrough into said at least one groove so that ventilting air is the only substance flowing in said at least one groove.

BRIEF DESCRIPTION OF THE DRAWINGS

These and other features of the present invention will become even more clear upon reference to the following description and in conjunction with the accompanying drawing wherein like numbers refer to like parts throughout the views and in which.

DESCRIPTION OF THE PREFERRED EMBODIMENT

Figure 1:
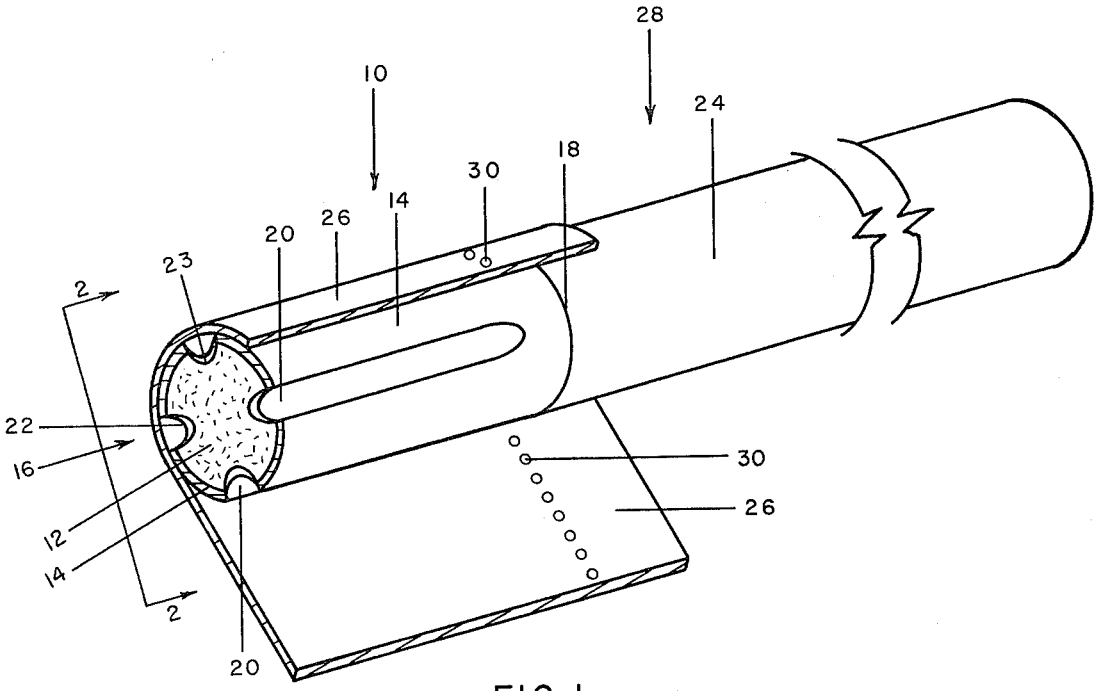
FIG. 1 is a perspective view of a cigarette filter of the present invention attached to a cigarette tobacco column with the tipping material partially unwrapped to more clearly show the various details.
Figure 2:
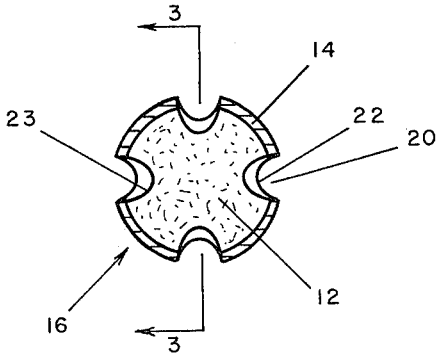
FIG. 2 is an enlarged end view taken in the direction of arrows 2—2 in FIG. 1 but with the tipping material completely removed for clarity.
Figure 3:
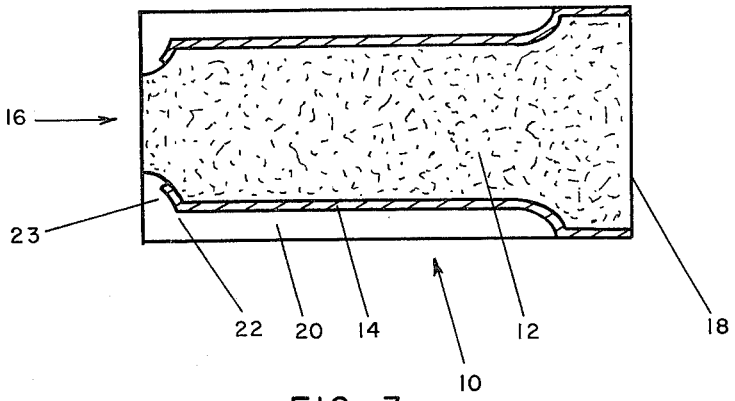
FIG. 3 is a longitudinal cross-sectional view taken in the direction of arrows 3—3 in FIG. 2.

FIGS. 1 through 3 illustrate a cigarette filter, generally denoted as the numeral 10, incorporating the features of the present invention. The cigarette filter 10 is shown as comprising a generally cylindrically shaped porous filter rod 12 and a circumscribing air impermeable wrapper 14. The wrapper 14 extends longitudinally along the filter rod 12 from one end 16 of the filter rod to the other end 18 thereof so that the filter rod ends 16 and 18 are in mutual flow through relationship.

The cigarette filter 10 further comprises a plurality of grooves 20 formed in the wrapper 14 and embedded into the filter rod 12. Each of the grooves 20 is open at one of its ends 22 to the mouth end 16 of the filter rod 12, and extends therefrom in a generally longitudinal direction of the filter rod 12 for a distance less than the length of the filter rod. The open end 22 of each groove 20 is recessed a predetermined distance inwardly from the mouth end 16 of the filter rod 12 and communicates with a different open cavity 23 formed in the mouth end 16 of the filter rod 12. The open cavities 23 depicted in FIGS. 1 through 3 extend from the recessed open end 22 of its communicating groove 20 in a generally radial direction of the filter rod 12 a distance less than one-half the radius of the filter rod 12. As illustrated in FIG. 3, the open cavities 23 each extend radially of the filter rod 12 beyond the open end 22 of the groove 20 by a distance generally corresponding to about the depth of a groove 20. FIGS. 1, 2 and 3 illustrate four grooves 20 equally spaced from each other about the circumference of the filter rod 12.

Figure 4:
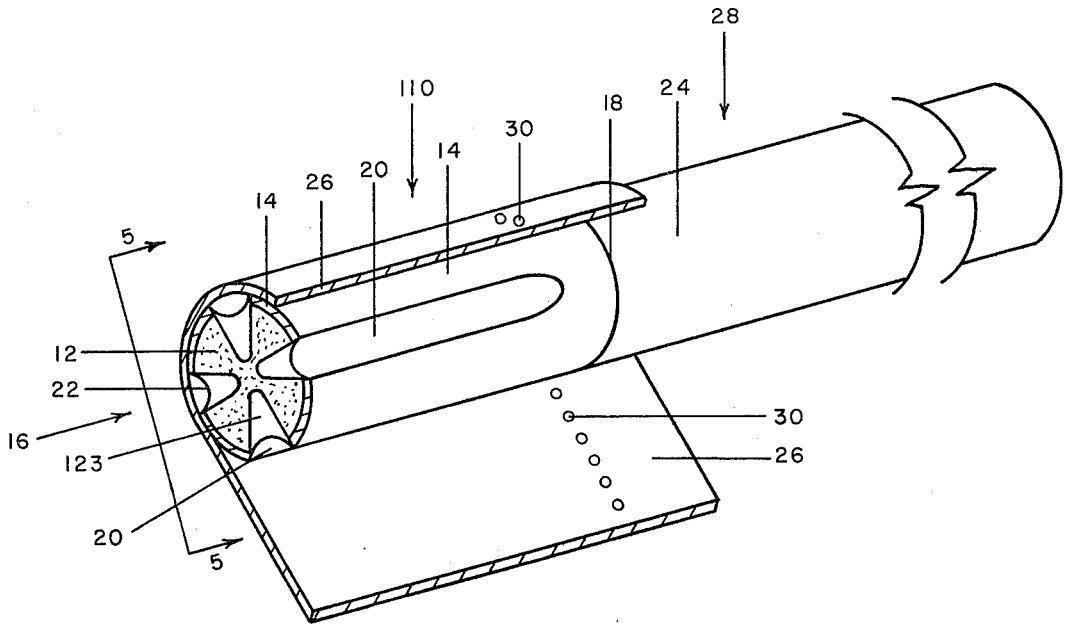
FIG. 4 is an enlarged perspective view of another cigarette filter embodying the features of the present invention attached to a cigarette tobacco column with the tipping material partially unwrapped to more clearly show various details.
Figure 5:
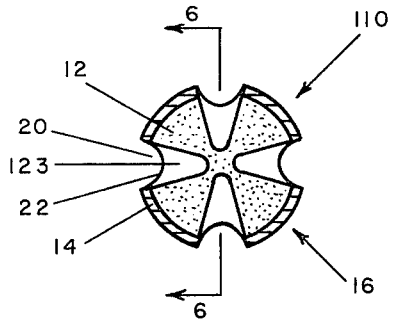
FIG. 5 is an enlarged end view of the cigarette filter of FIG. 4 as seen in the direction of arrows 5—5 but with the tipping material completely removed for clarity.
Figure 6:
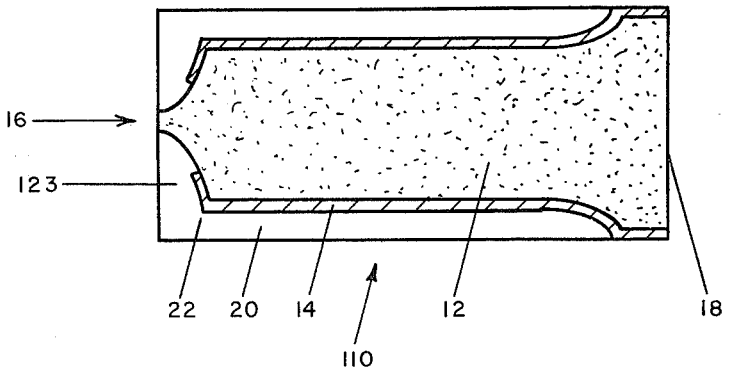
FIG. 6 is a longitudinal cross-sectional view taken in the direction of arrows 6—6 in FIG. 5.

FIGS. 4 through 6 illustrate a cigarette filter 110 which is identical to the cigarette filter 10 shown in FIGS. 1 through 3 with the exception that open cavities 123 are formed in the mouth end 16 of the filter rod 12. As in the filter 10, the recessed open end 22 of each groove 20 communicates with a different one of the open cavities 123. The open cavities 123 extend from the recessed open end 22 of its communicating groove 20 in a generally radial direction of the filter rod 12 for a distance greater than one-half of the radius of the filter rod 12 but less than the radius of the filter rod 12. Furthermore, as best can be seen in FIG. 5, each of the radially extending cavities 123 becomes progressively narrower from the open end 22 of its communicating groove 20 toward the center of the filter rod 12.

In addition, as illustrated in FIG. 6, the depth of each open cavity 123 at the open end 22 of its communicating groove 20 is approximately equal to the depth of the groove 20 and diminishes in depth progressively toward the center of the filter rod 12.

Figure 7:
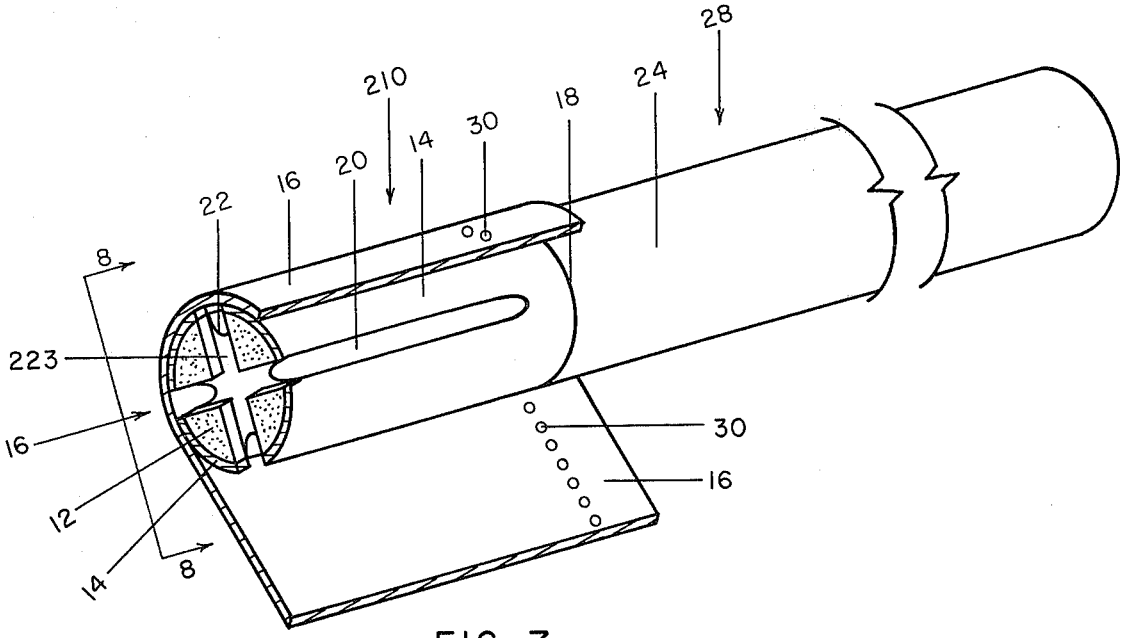
FIG. 7 is an enlarged perspective view of a further cigarette filter embodying the features of the present invention attached to a cigarette tobacco column with the tipping material partially unwrapped to more clearly show various details.
Figure 8:
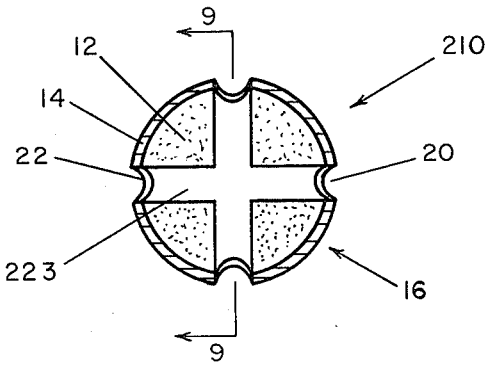
FIG. 8 is an enlarged end view of the cigarette filter of FIG. 7 as seen in the direction of arrows 8—8 but with the material completely removed for clarity.
Figure 9:
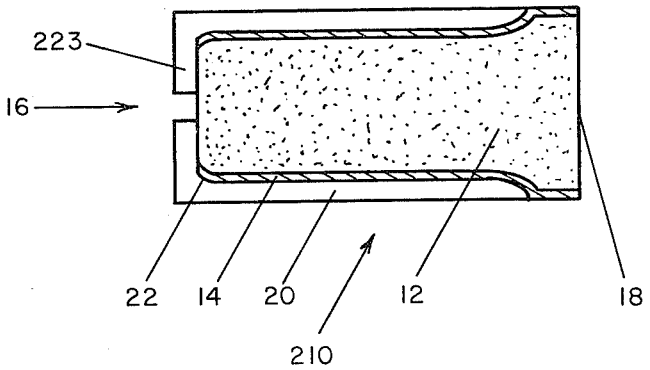
FIG. 9 is a longitudinal cross-sectional view taken in the direction of arrows 9—9 in FIG. 8.

FIGS. 7 through 9 illustrate a cigarette filter 210 which is also virtually identical with the cigarette filter 10 of FIGS. 1 through 3 except for the open cavities 223 formed in the mouth end 16 of the filter rod 12. As shown in FIGS. 7 through 9, open cavities 223 are formed in the mouth end 16 of the filter rod 12. Similarly to filters 10 and 110, the recessed open end 22 of each groove 20 communicates with a different one of the open cavities 223. The open cavities 223 extend from the recessed open end 22 of its communicating groove 20 in a generally radial direction of the filter rod 12 for a distance approximately equal to the radius of the filter rod 12 and are in mutual air flow communication at the proximate center of the filter rod 12. As can best be seen in FIG. 8, each of the cavities are of uniform width from the open end 22 of its communicating groove 20 toward the center of the filter rod 12. Furthermore, as illustrated in FIG. 9, the depth of each open cavity 223 is approximately equal to the depth of the grooves 20 over its entire length from its communicating groove 20 to the area of mutual communication with the other cavities 223.

The filter rod 12 is fabricated of a porous material such as, for example, fibrous or foamed acetate, or any other material suitable for filtering cigarette smoke.

As previously mentioned, the wrapper 14 is air impermeable. To this end, the wrapper 14 can be fabricated of a porous air permeable material such as, for example, a fibrous or foamed cellulose acetate and treated in a manner to seal the pores to render it air impermeable. One such treatment is to, for example, apply heat to the wrapper material to heat seal the porous material. Another effective treatment is to coat the porous material with a chemical such as a water insoluble solution or material, for example ethylcellulose, or a water-soluble material such as, for example, sodium CMC or methycellulose which seals the pores. Alternatively, the wrapper 14 can be fabricated of an air impermeable material such as, for example, a closed cell cellulose acetate.

In the manufacture of the filter 10, 110 and 210, the wrapper 14 can be integrally formed with the filter rod, or can be a separate component. For example, the wrapped filter rod is placed in a mold, or other treating means, for depressing the wrapper 14 at selected locations thus embedding the wrapper into the filter rod and forming the grooves 20 and depressing the filter material of the filter rod 12 at the mouth end 16 forming the open cavities 23, 123 and 223. One such method is commonly referred to in the cigarette manufacturing field as heat molding technique.

It should be clearly understood that another feature of the present invention concerning the open cavities 23, 123, 223 of the illustrated embodiments, is that the walls of the open cavities 23, 123, 223 formed by the depressed areas at the mouth end of the filter rod 12 can be made air impermeable or air permeable, at least to some extent. The depressed area of the porous filter rod 12 forming the open cavities can be made air impermeable, or selectively less permeable than the porous filter rod, by, for example, heat treating or chemically treating them in a similar manner to that discussed above regarding the treatment of the wrapper 14 to render it air impermeable.

The wrapped filter rod 12 is attached to a tobacco column 24 with a tipping material 26 which circumscribes the wrapper covered filter rod 12 to form a filtered cigarette 28. The tipping material 26 is air permeable so that ventilating air will flow through it and into the grooves 20. To this end, the tipping material 26 is illustrated as being formed with flow-through ventilating air perforations 30. As shown, the perforations 30 are formed through the tipping material 26 in a circumferential array around the wrapped filter rod and communicate with the grooves 20 near their closed ends, i.e., that end of each groove opposed to its open end 22.

As a manufacturing expedient in the formation of the filter 10, 110 and 210, it is foreseeable that some of the perforations 30 in the circumferential array will overlay the wrapped filter rod in the areas between adjacent grooves 20, however because the wrapper 14 is air impermeable no air will pass through the wrapper into the filter rod 12.

When a smoker draws on the mouth end 16 of the filter 10, 110 and 210 while smoking the cigarette 28, ventilating air is drawn through the perforations 30 into the grooves 20. The ventilating air entering the grooves 20 travels directly to the open end 22 of the groove at the mouth end of the filter rod without mixing with smoke flowing through the filter rod because of the impervious wrapper 14. As the ventilating air exits the open ends 22 of the grooves 20 and flows into the cavities 23, 123 and 223 creating eddies. These eddies at the mouth end of the filter entrain the smoke exiting the mouth end of the filter and disperse the smoke in the mouth of the smoker enhancing the perceived taste.

The foregoing details of the present invention are given primarily for clearness of understanding and no unnecessary limitations should be understood therefrom for modifications will become obvious to one skilled in the art upon reading this disclosure and can be made without departing from the spirit of the invention and scope of the appended claims.

The invention claimed is:

1. A filter for a cigarette comprising:

a porous filter rod of generally cylindrical configuration;

an air impermeable wrapper extending longitudinally along said filter rod from one end thereof to the other end and circumscribing said rod leaving flow-through opposed ends of said filter rod;

said wrapper being formed with at least one groove embedded into said filter rod, said at least one groove being open at one end of said filter rod and extending therefrom in a generally longitudinal direction of said filter rod for a distance less than the length of said filter rod, and the open end of said at least one groove being recessed a predetermined distance inwardly of the end of said filter rod;

means defining at least one cavity formed in the end of said filter rod, said at least one cavity being open to the end of said filter rod and being in air flow communication with said recessed open end of said at least one groove, and said cavity extending from said recessed open end of said at least one groove in a generally radial direction of said filter rod; and, tipping material extending longitudinally of and circumscribing said wrapped filter rod, said tipping material being air permeable permitting ventilating air flow therethrough into said at least one groove.

2. The filter defined in claim 1 wherein said at least one cavity extends generally radially of said filter rod a distance less than one-half the radius of said filter rod.

3. The filter defined in claim 2 wherein said at least one cavity extends generally radially of said filter rod beyond the open end of said at least one groove by a distance generally corresponding to about the depth of said at least one groove.

4. The filter defined in claim 1 wherein said at least one cavity extends generally radially of said filter rod a distance equal to or greater than one-half, but less than the radius of said filter rod.

5. The filter defined in claim 1 wherein said at least one groove comprises a plurality of grooves spaced from each other circumferentially of said filter rod;

said at least one cavity comprises a plurality of cavities equal in number to the number of said grooves, each cavity being in air flow communication with the open end of a different one of said grooves and extending therefrom in a generally radial direction of said filter rod for a distance approximately equal to the radius of said filter rod, and all of said radially extending cavities being in mutual air flow communication at the proximate center of said filter rod.

6. The filter defined in claim 1 wherein the wall of said at least one open cavity is air impermeable.

7. The filter defined in claim 1 wherein the wall of said at least one open cavity is air permeable.

8. The filter defined in claim 1 wherein the depth of said at least one open cavity diminishes from the open end of said at least one groove toward the center of said filter rod.

9. The filter defined in claim 1 wherein the depth of said at least one open cavity is uniform from the open end of said at least one groove toward the center of said filter rod.

10. The filter defined in claim 1, wherein said at least one open cavity is of uniform width from the open end of said at least one groove toward the center of said filter rod.

11. The filter defined in claim 1, wherein the width of said at least one open cavity narrows from the open end of said at least one groove toward the center of said filter rod.

* * * * *